US010502052B2

(12) United States Patent
Barak et al.

(10) Patent No.: US 10,502,052 B2
(45) Date of Patent: Dec. 10, 2019

(54) DEVICES AND METHODS FOR FILTERING PUMP INTERFERENCE IN MUD PULSE TELEMETRY

(71) Applicant: Halliburton Energy Services, Inc., Houston, TX (US)

(72) Inventors: Ehud Barak, Houston, TX (US); Yumin Zhang, Allen, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 31 days.

(21) Appl. No.: 15/524,252

(22) PCT Filed: Dec. 10, 2014

(86) PCT No.: PCT/US2014/069529
§ 371 (c)(1),
(2) Date: May 3, 2017

(87) PCT Pub. No.: WO2016/093819
PCT Pub. Date: Jun. 16, 2016

(65) Prior Publication Data

US 2018/0298749 A1 Oct. 18, 2018

(51) Int. Cl.
*E21B 47/18* (2012.01)
*E21B 7/04* (2006.01)
(Continued)

(52) U.S. Cl.
CPC ..... *E21B 47/18* (2013.01); *E21B 7/046* (2013.01); *E21B 21/08* (2013.01); *E21B 47/06* (2013.01);
(Continued)

(58) Field of Classification Search
CPC ..... E21B 47/12; E21B 47/14; E21B 47/18; E21B 47/182; E21B 47/185; E21B 47/187; E21B 47/06; E21B 7/046; E21B 21/08
See application file for complete search history.

(56) References Cited

U.S. PATENT DOCUMENTS 5,146,433 A 9/1992 Kosmala et al.
6,308,562 B1 10/2001 Abdallah et al.
(Continued)

FOREIGN PATENT DOCUMENTS

EP 0078906 A2 5/1983
EP 0078907 A2 5/1983
(Continued)

OTHER PUBLICATIONS

International Search Report and Written Opinion for PCT/US2014/069529 dated Aug. 26, 2015.
(Continued)

*Primary Examiner* — Franklin D Balseca
(74) *Attorney, Agent, or Firm* — Gilliam IP PLLC

(57) ABSTRACT

Systems and methods for filtering pump interference in mud pulse telemetry are provided. A method includes receiving a monitor output, selecting an adaptive factor in an adaptive filter module, and adjusting the adaptive factor when the adaptive filter module has reached convergence. The method may further include receiving a sensor input, providing a filtered signal output, and modifying a drill configuration based on the signal output. A system configured to perform the method above is provided. A method as above further including modifying a drill configuration based on the signal output is provided.

20 Claims, 8 Drawing Sheets

(51) Int. Cl.
*E21B 21/08* (2006.01)
*E21B 47/06* (2012.01)
*E21B 47/12* (2012.01)

(52) U.S. Cl.
CPC ..... *E21B 47/12* (2013.01); *E21B 47/182* (2013.01); *E21B 47/185* (2013.01); *E21B 47/187* (2013.01)

(56) References Cited

U.S. PATENT DOCUMENTS 6,470,275 B1 10/2002 Dubinsky
6,657,597 B2 12/2003 Rodney et al.
6,741,185 B2 * 5/2004 Shi ..... E21B 47/18 175/40
6,781,520 B1 8/2004 Smith et al.
7,324,010 B2 1/2008 Gardner et al.
7,345,594 B2 3/2008 Huang et al.
7,423,550 B2 9/2008 Reckmann et al.
7,577,528 B2 * 8/2009 Li ..... E21B 47/18 702/6
7,783,032 B2 * 8/2010 Abutalebi ..... G10L 21/0208 379/406.09
7,830,749 B2 11/2010 Kyllingstad
7,835,226 B2 * 11/2010 Kokosalakis ..... H04B 13/00 340/854.4
8,380,438 B2 2/2013 Jarrot et al.
8,659,297 B2 * 2/2014 Shafiee Haji Abadi ..... A61B 5/7207 324/318
9,037,004 B2 * 5/2015 Ogasahara ..... H04B 10/6166 398/205
2002/0180613 A1 12/2002 Shi et al.
2004/0155794 A1 8/2004 Gardner
2007/0192031 A1 8/2007 Li et al.
2007/0201308 A1 8/2007 Wassermann et al.
2010/0314169 A1 12/2010 Jarrot et al.
2011/0187553 A1 8/2011 Rodney
2013/0011144 A1 1/2013 Amid Farahani et al.
2014/0017092 A1 1/2014 Brackel
2016/0092482 A1 * 3/2016 Haq ..... G06Q 10/06 707/754

FOREIGN PATENT DOCUMENTS

RU 2144684 C1 1/2000
WO 2014035914 A1 3/2014
WO 2014193648 A1 12/2014

OTHER PUBLICATIONS

Tu et al. "Research on mud pulse signal data processing in MWD." EURASIP Journal on Advances in Signal Processing 2012:182 (7 pages).
Yoo et al. "An Affine Projection Algorithm with Variable Projection Order using the MSE Criterion." Proceedings of the International MultiConference of Engineers and Computer Scientists 2012 vol. II, IMECS 2012, Mar. 14-16, 2012, Hong Kong (4 pages).
RU Application No. 2017114502 (Foreign Counterpart Application); Decision on Grant; dated Aug. 10, 2018; English translation included, 16 pages.
CA Application Serial No. 2,966,499, Office Action, dated Feb. 13, 2019, 4 pages.

* cited by examiner

DEVICES AND METHODS FOR FILTERING PUMP INTERFERENCE IN MUD PULSE TELEMETRY

BACKGROUND

In the field of oil and gas exploration and extraction, pressure sensors are customarily used at the surface for reading data provided by acoustic transducers at the downhole. The data travels through the drilling mud along the wellbore, typically in the form of short pulses providing a binary encoded signal. One of the most severe interference sources for mud pulse telemetry is the perturbation generated by the pumps that circulate the mud. Many attempts have been made to reduce or eliminate pump interference. For example, some attempts include the use of two or more sensors having a well-known signal delay between one another. Other approaches include averaging algorithms combined with pump stroke monitors to generate a signature of the pump interference. Some of these methods rely on assumptions such as the shape of the pump interference being the same or similar for different sensors. In other methods the outputs of the two sensors are used to calculate the transfer function between the sensors and from that, the received signal. However, these approaches are hindered by the small difference typically encountered between the signals of the two or more sensors, even when they are placed far apart from each other, as compared to the amplitude of pump interference.

In many instances circulation and drilling must be stopped in order to collect reference data and elaborate complex mathematical models are needed for interference rejection. Some of the mathematical models used include cancellation of the harmonics of pump interference using Fast Fourier Transform (FFT) to generate a reference signal representing pump cycles. Calculations that are more sophisticated include interpolation of out-of-band frequency components of the pump interference to find in-band harmonics and generate a reference signal. Some approaches use linear prediction to generate an all-pole model of the pump interference, where a delayed version of a received signal is used to estimate pump interference. In further approaches, a known sequence of pulses is transmitted at least twice through the system (in both directions) to accurately calculate a transfer function between the deployed sensors.

Most systems use large 'acoustic' capacitors to act as pump dampeners. These devices operate as large balloons made of a resilient material that swells with drilling mud, thus acoustically isolating a pressure sensor from the pumps. Still, 'acoustic' capacitors are unable to provide the level of attenuation desired when an acoustic transducer is far deep inside a wellbore. More generally, state-of-the-art modelling of pump interference neglects data transfer noise sources, such as drill bit noise in the wellbore. Furthermore, techniques such as described above are time consuming and expensive in terms of instrumentation, involving a plurality of acoustic transducers and sensitive detection equipment.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
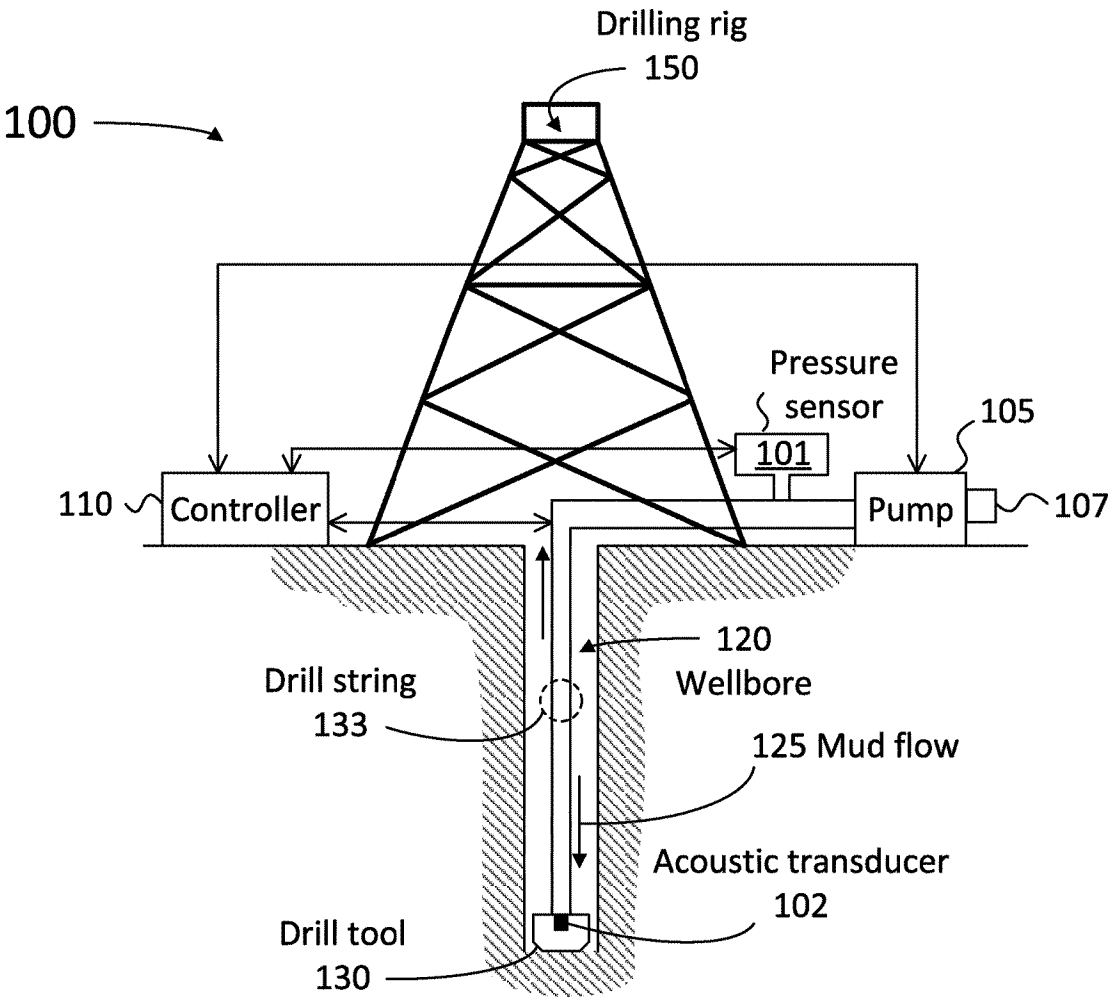
FIG. 1 illustrates a drilling system using a pressure sensor configured to filtering pump interference in mud pulse telemetry, according to some embodiments.

The present disclosure relates to methods and devices for telemetry schemes used in oil and gas exploration and extraction and, more particularly, to methods and devices for filtering pump interference in mud pulse modulation telemetry. Embodiments consistent with the present disclosure filter a pump interference from the signal received by a single sensor. Furthermore, embodiments as disclosed herein avoid the transmission of special data sequences to filter the pump interference, thus reducing the amount of idle time of the data processing system. Further, embodiments as disclosed herein avoid the need to stop the pump or the signal to measure transfer functions and other complex mathematical objects used in sophisticated filtering schemes.

Accordingly, embodiments consistent with the present disclosure use a signal from stroke-monitors in the pumps to generate an interference reference for adaptive filters as disclosed herein. Some embodiments include a pre-processor module that finds the rising edges of the output signal from a stroke monitor. This helps regenerate most of the harmonics of the pump interference. Embodiments consistent with the present disclosure incorporate and track in real time changes in the pump operation frequency. In some embodiments, the adaptive filter is an affine projection filter. Affine projection adaptive filters typically converge faster and have less residual noise than least mean squares (LMS) filters, and are also more stable than recursive least squares (RLS) filters.

Embodiments consistent with the present disclosure include an adaptive filter for removing pump interference from a signal generated by an acoustic transducer as part of a Mud Pulse Telemetry (MPT) system. In some embodiments, an MPT system uses the mud flow in a drilling system as a medium for sending information from the Bottom Hole Assembly (BHA) to the surface. The mud flow is pushed by one or more high pressure pumps through the drill string and returns back to the surface through the space between the drilling pipe and a well case. At the bottom of the wellbore, the BHA uses an acoustic transducer to send pulses through the mud flow. These pulses are added to the interference signal generated by the mud pump and are received by a pressure sensor at the surface. In some embodiments, the pump action is periodic, thus the pump interference is a periodic waveform (e.g., a sinusoidal wave). The acoustic transducer may be far from the pressure sensor, typically at distances ranging from a few thousand feet and up to thirty thousand feet. On the contrary, the pumps are much closer to the pressure sensor. Accordingly, the acoustic transducer signal can be substantially lower than the pump interference. This may cause a very low Signal-to-Noise Ratio (SNR) and prevent detection of the signal from the acoustic transducer. Furthermore, in many circumstances a plurality of pumps actuates on the drilling system, each operating at a slightly different frequency, thereby providing a combined interference signal that may include many frequency components. Moreover, the interference signals from a plurality of pumps may have incoherent phases with respect to one another, making it more difficult to filter out.

Systems and methods for filtering pump interference in mud pulse telemetry are provided. In one embodiment, a method includes receiving a monitor output, selecting an adaptive factor in an adaptive filter module, and adjusting the adaptive factor when the adaptive filter module has reached convergence. The method may further include receiving a sensor input, providing a filtered signal output, and modifying a drill configuration based on the signal output.

A device according to some embodiments includes a memory circuit storing commands and a processor circuit configured to execute the commands. When the processor circuit executes the commands, it causes the device to receive a monitor output, to select an adaptive factor in an adaptive filter module, to adjust the adaptive factor when the adaptive filter module has reached convergence, and to receive a sensor input. Further according to some embodiments the device may provide a filtered signal output and modify a drill configuration based on the filtered signal output.

A method consistent with embodiments herein may include receiving a stroke monitor signal, increasing a bandwidth of the stroke monitor signal to form an adaptive filter input, and applying an adaptive filter to the adaptive filter input. Some embodiments further include adjusting the adaptive filter to reduce an error, receiving a pressure sensor input, filtering a pump interference from the received pressure sensor input, and adjusting a drilling configuration based on the filtered pressure signal.

FIG. 1 illustrates a drilling system 100 using a pressure sensor 101 configured to suppress pulse reflections in a pulse modulation telemetry configuration, according to some embodiments. Drill system 100 may be a logging while drilling (LWD) system, as is well known in the oil and gas industry. A pump 105 maintains a mud flow 125 down a wellbore 120 dug by a drill tool 130. A drill string 133 couples drill tool 130 with equipment on the surface, such as pump 105 and pressure sensor 101. The tools are supported by drilling rig 150. A controller 110 is coupled to pressure sensor 101, to pump 105, and to acoustic transducer 102, via wellbore 120. Controller 110 may include a computer system configured to receive data from and transmit commands to pressure sensor 101, acoustic transducer 102, and pump 105.

Mounted near the drill tool 130, an acoustic transducer 102 is configured to transmit messages to the surface with information related to the drill process. Messages created by acoustic transducer 102 may be digitally encoded sequences of acoustic pulses transmitted through mud flow 125 and read by pressure sensor 101. Accordingly, a plurality of digital signal modulation schemes may be used to transmit messages between acoustic transducer 102 and pressure sensor 101, such as Pulse Position Modulation (PPM) and Pulse Width Modulation (PWM). As a response to the messages transmitted between pressure sensor 101 and acoustic transducer 102, controller 110 may adjust a drilling configuration in drilling system 100. For example, a drilling speed may be increased, reduced, or stopped by controller 110, based on messages received from acoustic transducer 102. Moreover, in some embodiments controller 110 may cause drill tool 130 to steer in a different drilling direction. For example, in some embodiments drill tool 130 may be steered from a vertical drilling configuration (as shown in FIG. 1) to a horizontal or almost horizontal drilling configuration. In some embodiments, adjusting the drilling configuration may include adjusting mud flow 125. For example, mud flow 125 may be increased or reduced, or the pressure exerted by pump 105 may be increased or reduced. Moreover, in some embodiments adjusting the drilling configuration may include adding chemicals and other additives to mud flow 125, or removing additives from mud flow 125.

A stroke monitor 107 is mounted on pump 105 and sends a signal associated with the pump rotation. In some embodiments, stroke monitor 107 includes a sensor that operates as a contact switch, closed for a portion of each revolution of the pump axis.

Figure 2:
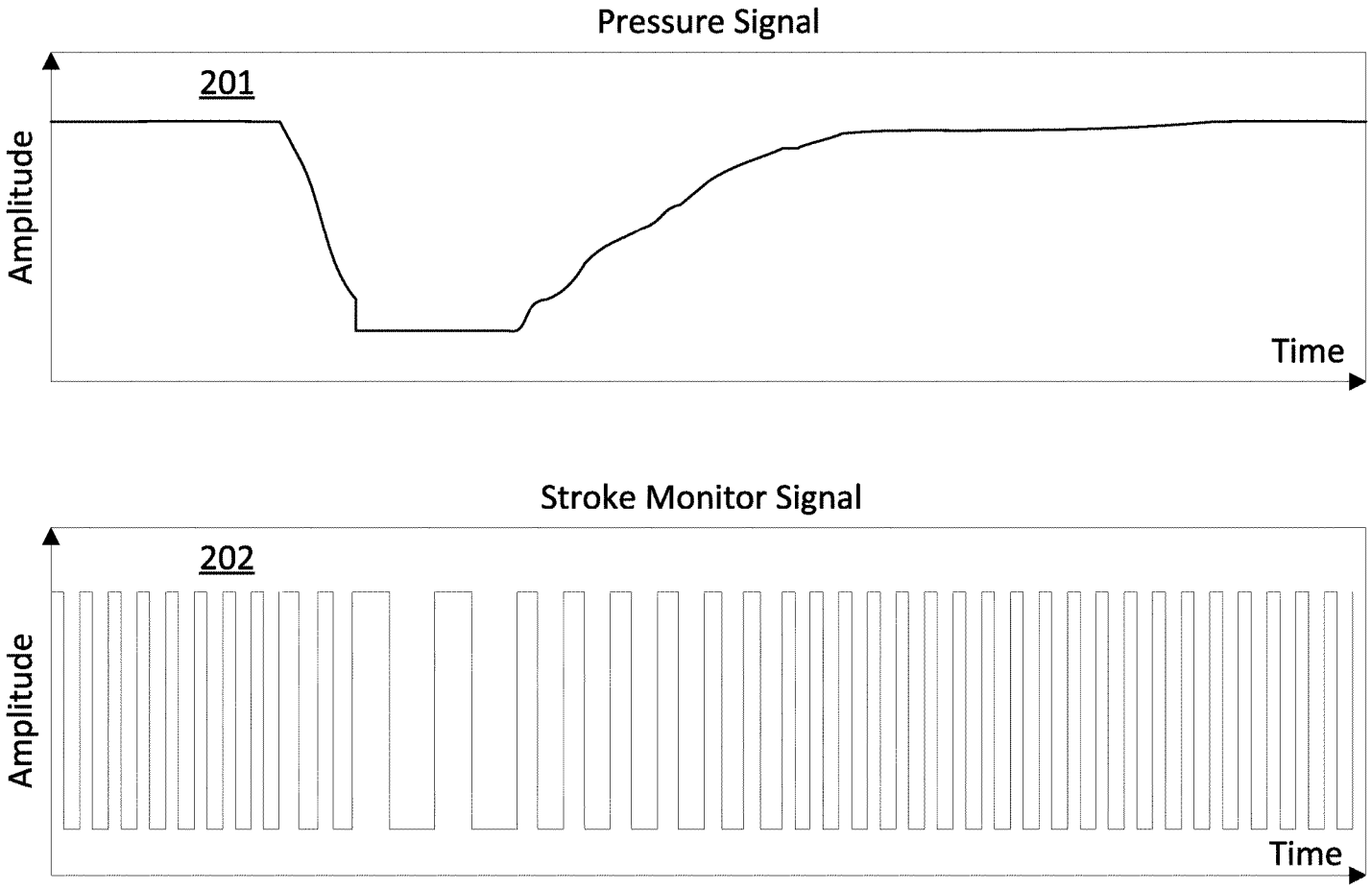
FIG. 2 illustrates a pressure signal and a stroke monitor signal, according to some embodiments.

FIG. 2 illustrates a pressure signal 201 and a stroke monitor signal 202, according to some embodiments. In FIG. 2 the abscissa represents time (in arbitrary units), and the ordinates represent a signal amplitude (in arbitrary units). Pressure signal 201 is monitored by pressure sensor 101 (cf. FIG. 1). When pump 105 slows down, the total pressure in mud flow 125 falls and it rises back when pump 105 resumes the original speed. Embodiments of the present disclosure provide a pump interference filter for receiving a signal from acoustic transducer 102 that is resistant to a pressure drop event as illustrated by pressure signal 201. When pump 105 operates at a constant speed, stroke monitor signal 202 is a square wave with constant period and a given duty cycle. When pump 105 changes speed during a pressure drop event, the frequency of the pulses in stroke monitor signal 202 changes accordingly, as shown in FIG. 2. In some embodiments, the duty cycle of stroke monitor signal 202 remains the same through the change in rotational speed of pump 105.

Figure 3:
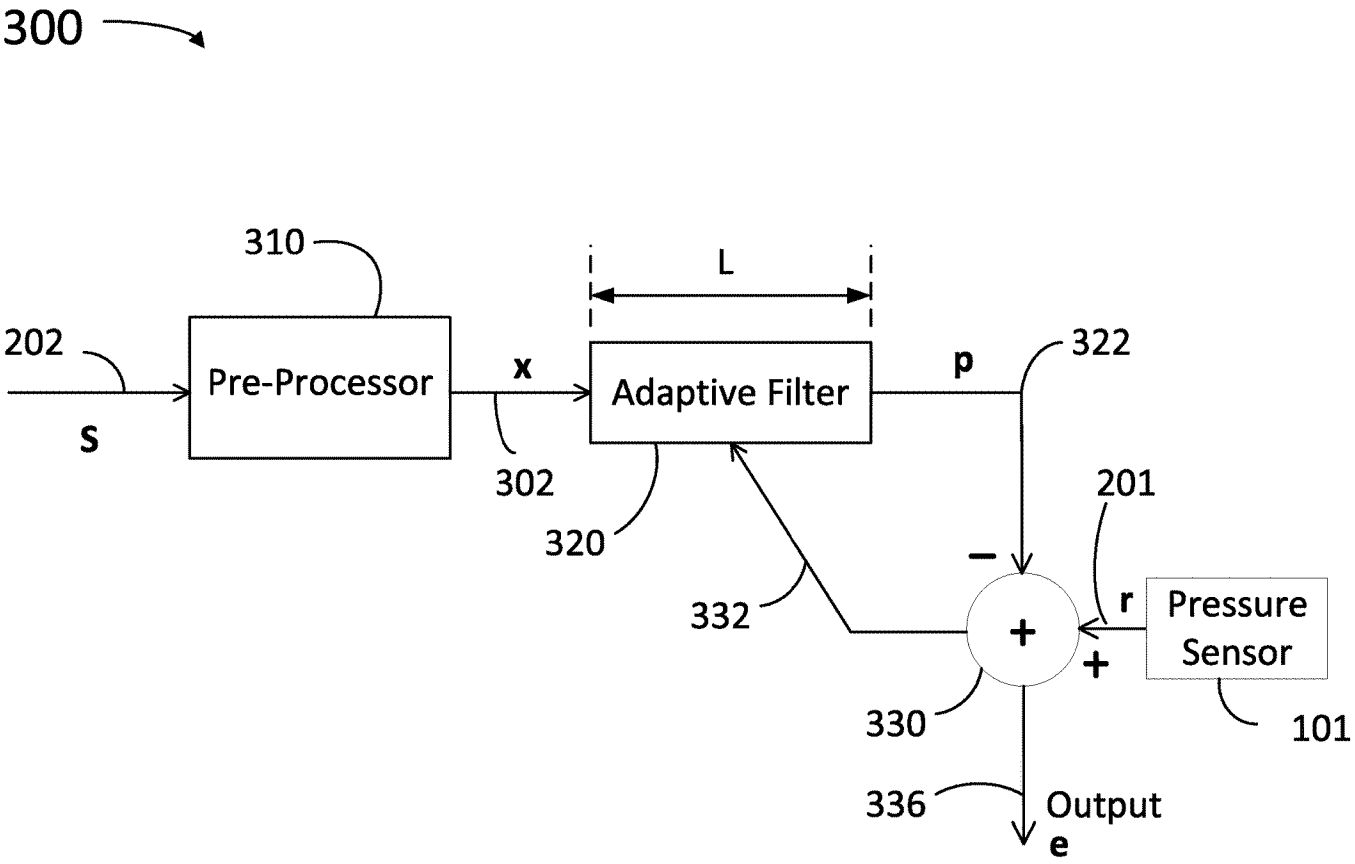
FIG. 3 illustrates a block diagram of a pump interference filter to remove pump interference in mud pulse telemetry, according to some embodiments.

FIG. 3 illustrates a block diagram of a pump interference filter 300 to remove pump interference in mud pulse telemetry, according to some embodiments. A pre-processor module 310 receives and modifies stroke monitor signal 202 (S) into an adaptive filter input 302 ($x$). An adaptive filter module 320 uses adaptive filter input 302 to provide a reference signal 322 ($p$). A combiner module 330 receives pressure signal 201 ($r$) from pressure sensor 101 and forms output signal 336 ($e$) by subtracting reference signal 322 ($p$) from pressure sensor signal 201 ($r$). Pressure signal 201 may be as described in detail above in reference to FIG. 2. In embodiments consistent with the present disclosure, adaptive filter module 320 reduces a cost function using a feedback input 332. The cost function may be defined in terms of pressure signal 201 and feedback input 332. In turn, feedback input 332 is determined by output signal 336 modulated by an adaptive factor $\mu$. In some embodiments, feedback input 332 is the same as output signal 336 and the adaptive factor, $\mu$, is applied to feedback input 332 within adaptive filter 320. In one embodiment of the disclosure, adaptive filter module 320 is a linear Finite Impulse Response (FIR) filter and the cost function is the Mean Squared Error (MSE) of the difference between pressure signal 201 and adaptive filter output 322.

In some embodiments, the convergence of adaptive filter module 320 to a desirable solution is faster when the input signal (x) is a random signal with a broad bandwidth. In embodiments where the input signal is a periodic, or substantially periodic signal, as in the case of adaptive filter input 302 (*x*), a reduced bandwidth may result in a slow convergence of adaptive filter module 320. In addition, when the duty cycle of stroke monitor signal 202 is close to 50%, half of the harmonics disappear. For example even harmonics may be absent from stroke monitor signal 202, resulting in a biased output. Accordingly, in some embodiments pre-processor module 310 is configured to restore the harmonics of the reference signal. When most of the interference is included in these harmonics, filtering out their effect effectively removes most of the pump interference.

Figure 4:
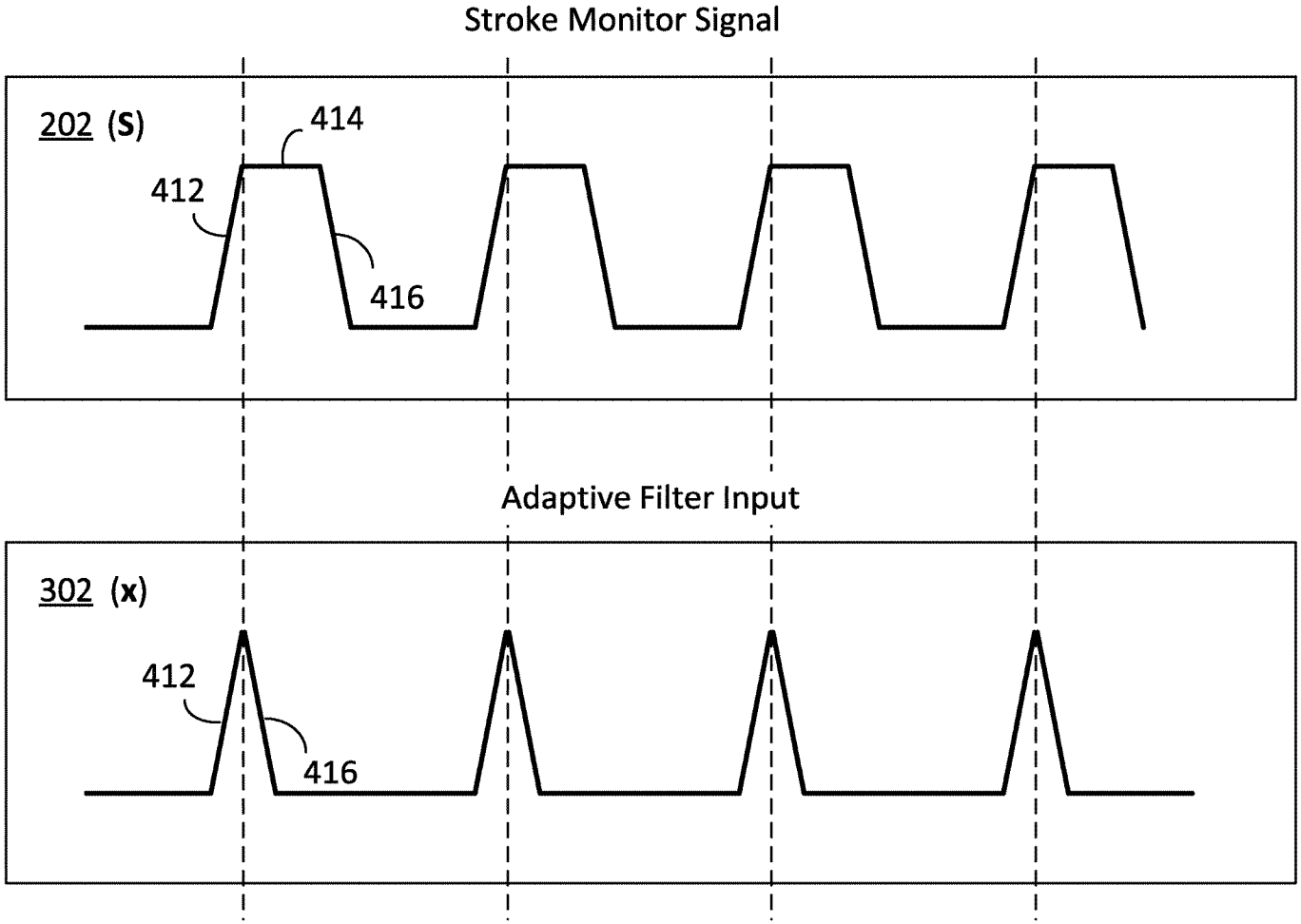
FIG. 4 illustrates a stroke monitor signal and an adaptive filter input, according to some embodiments.

FIG. 4 illustrates a stroke monitor signal 202 (S) and an adaptive filter input 302 (*x*), according to some embodiments. In FIG. 4 the abscissa represents time (in arbitrary units), and the ordinates represent a signal amplitude (in arbitrary units). In FIG. 4 stroke monitor signal 202 includes a rising edge 412, a flat top 414, and a falling edge 416. Adaptive filter input 302 retains raising edge 412 and falling edge 416 from stroke monitor signal 202, but removes flat top 414. Accordingly, adaptive filter input 302 replaces each of the square pulses in stroke monitor signal 202 with sharp peaks. As a result, adaptive filter input 302 has a broader frequency content than stroke monitor signal 202. Using adaptive filter input 302 as an input for adaptive filter 320 is desirable because the effectiveness of the filter increases with increased input bandwidth. In some embodiments, the sharper features on a time scale (abscissa in FIG. 4) of adaptive filter input 302 provide an enhanced time resolution that is desirable for pump interference removal.

In reference to FIGS. 3 and 4, variables S, x, p, r and e may be linear arrays indexed with respect to an integer value, 'n', that indicates a time sequence. For example, the vertical dashed lines in FIG. 4 may define the time sequence, in some embodiments. More generally, in some embodiments the time sequence may not coincide exactly with peaks, troughs, or any other specific features of pressure signal 201 or stroke monitor signal 202. Moreover, in a broader sense the time sequence for indexing arrays S, x, p, r and e may not be an even partition of a time interval. In some embodiments the time sequence is given by a clocking signal in a digital sampling circuit or a computer system in controller 110 (cf. FIG. 1). For example, the sampling circuit may operate at a rate of about 500 Hz or less, in some embodiments. Typically, a signal from acoustic transducer 102 has a frequency less than about 50 Hz. Having a pump interference that is less than 100 Hz, pump interference filter 300 may include filters to suppress inputs r 201 and S 202 beyond 125 Hz (by applying suitable electronic filtering techniques). Furthermore pump interference filter 300 may apply a sampling rate of 250 Hz to form the waveforms shown in FIG. 4. It is noted that the specific frequency ranges given above are illustrative only, and not limiting of different embodiments within the scope of the present disclosure. In that regard, the size of linear arrays S, x, p, r, and e is defined by a length, L, configured in adaptive filter 320. The value of L is an integer number of samples obtained from the pressure sensor with a sampling circuit as described above.

Adaptive filter output 322 (*p*) may result from applying a filter function W defined by coefficients $W_n$, onto adaptive filter input 302 (*x*), as:

$$p_n = \sum_{0}^{L-1} W_k \cdot x_{n-k} \tag{1}$$

Output 336 (*e*) can be written as $$e_n = r_n - p_n = r_n - \sum_{0}^{L-1} W_k \cdot x_{n-k} \tag{2}$$

The MSE criterion as disclosed herein includes minimizing the average of the squared amplitude of error 336 ($<e_n^2>$). Using this criterion, the adaptive filter is configured to remove component correlated to the stroke monitors from the signal. Assuming there is no correlation between the stroke monitors and the transmitted signal, the pump interference is selectively suppressed. Different methods may be used to implement adaptive filter module 320. In one embodiment, an Affine Projection (AP) method of order 'N' is used, where N can be any integer (for example 4), as follows. The adaptation process for AP of order 'N' assuming the adaptive filter is of length L can be described as follows: Assume that a vector is written in capital letters while a scalar is written in small letters. The update equation for the pump filter W at time n will be:

$$W_{n+1}=W_n+\mu A_n^T\cdot(A_n\cdot A_n^T)^{-1}E_n \tag{3}$$

where $$A_n=[X_n \ldots X_{n-N+1}]^T \tag{4}$$

is a matrix of the input x, where each row is a shifted version of the previous row.

$$X_n=[x_n \ldots x_{n-M+1}]^T \tag{5}$$

and:

$$E_n=[e_n \ldots e_{n-N+1}] \tag{6}$$

is a matrix of the output, e, where each row is a shifted version of the previous row. In many instances, signal r 201 received from pressure sensor 101 including useful data from acoustic transducer 102 in wellbore 120 may be highly correlated to the pump interference. In such configurations, adaptive filter 320 may have increased fluctuations and not converge within a reasonable time. Furthermore, in some embodiments when the useful data from acoustic transducer 102 is included in signal r 201, adaptive filter 320 may effectively suppress the signal altogether, including the useful data. To avoid either of the two extremes, some embodiments employ a gear shifting scheme for adaptive filter stage 320. In some embodiments, adaptive factor, μ, is used in the gear shifting scheme as follows. The adaptive factor, μ, has two competing effects on the convergence of adaptive filter module 320:

1. Increasing convergence speed: a higher value of μ results in faster adaptive filter convergence; and
2. Increasing fluctuation noise (i.e., miss-adjustment). Fluctuation noise is a steady state noise caused by fluctuation of filter coefficients W from iteration 'n' to iteration 'n+1' (cf. Eq. 3): a higher value of μ results in greater miss-adjustment.

Because of competing effects 1 and 2, some trade-off is needed in selecting adaptive factor, μ.

In some embodiments, a value of μ below 0.5 may prevent divergence of adaptive filter module 320. Accordingly, some embodiments avoid values of μ higher than 0.5. In some embodiments, a value for μ as high as 0.2 may be selected. In the gear shifting scheme, the starting value of μ is progressively reduced as the filter converges and the number of iterations increases. The convergence can be tested by checking the rate of change of the adaptive filter coefficients ($|W_n - W_{n+1}|$, cf. Eq. 3). In some embodiments, the iterations described in Eq. 3 may be terminated at a fixed time ('$n_{final}$') after the initialization. For example, in some embodiments eight (8) gear shifting steps may be applied, at each step the value of μ may be reduced by some factor, for example 0.55. The steps may occur at fixed time intervals (fixed sampling number). After reaching convergence at a final value, μ, remains with this value until the next reset of the system. This reset can be triggered for example by calculating the pump stroke monitors frequency and comparing it to some low threshold. In some embodiments, a reset may be triggered by a change in the pump frequency, the pump phase, or even the addition or subtraction of an extra pump to the drilling system. Without limitation, a low threshold value may be, for example, twelve (12) Hz. Thus, when the stroke monitor frequency falls below 12 Hz the reset is triggered.

In some embodiments, x 302 may include long strings of the same or similar values. for example x 302 might include a long strings of zeroes. This can cause the matrix $A_n$ (cf. Eq. 4) to become singular and matrix ($A_n \cdot A^T$) may not be invertible, as in Eq. 3. In order to prevent such a scenario, some embodiments include a decimation of the errors. Thus, instead of taking the last N errors, an arbitrary sequence of non-consecutive N previous errors is considered. For example—assume that instead of taking the errors ($e_n$, $e_{n-1}$ $e_{n-2}$, $e_{n-3}$) we take the sequence ($e_{n-k0}$ $e_{n-k1}$ $e_{n-k2}$, $e_{n-k3}$). The sequence $\{k_0, k_1, k_2, k_3\}$ can be any sequence of integers for example {0, 5, 11, 23}. This sequence can now be used to update the adaptive filter W (cf. Eq. 3).

$$A_n = [X_{n-k0} \ldots X_{n-kN-1}]^T \tag{6}$$

$$E_n = [e_{n-k0} \ldots e_{n-kN-1}] \tag{7}$$

Figure 5:
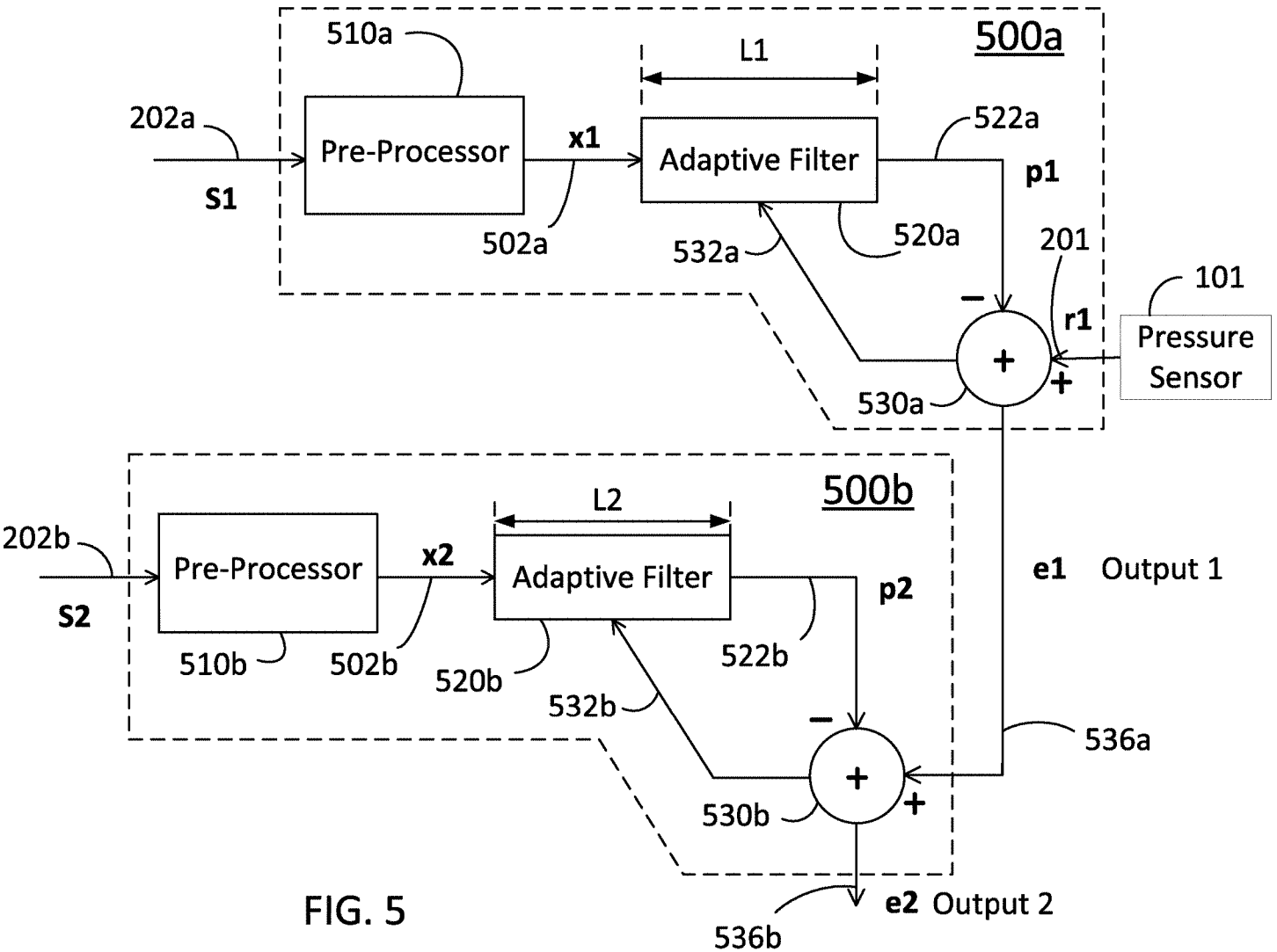
FIG. 5 illustrates a block diagram of cascaded pump interference filters to remove two pump interferences in mud pulse telemetry, according to some embodiments.

FIG. 5, with continuing reference to FIG. 1, illustrates a block diagram of cascaded pump interference filters 500*a,b* used to remove two pump interferences in mud pulse telemetry, according to some embodiments. In many cases more than one pump 105 is used for pushing mud flow 125 through drill string 133. Accordingly, each pump 105 might have a different stroke rate. Embodiments consistent with the present disclosure may remove the combined interference of multiple pumps using the cascading array of filters 500*a* and 500*b*, as shown in FIG. 5.

Without loss of generality, FIG. 5 illustrates two cascaded interference filters 500*a* and 500*b* to remove interferences from two pumps (hereinafter referred to collectively as filters 500). It will be recognized that interferences from any number, K, of pumps may be addressed by cascading an equal number, K, of interference filters 500. Each of the pumps may include a stroke monitor, thus providing stroke monitor signal (S1) 202*a* for the first pump, and stroke monitor signal (S2) 202*b* for the second pump. Pump interference filter 500*a* includes a pre-processor module 510*a*, an adaptive filter module 520*a*, and a combiner module 530*a*. Accordingly, pump interference filter 500*a* processes adaptive filter input (x1) 502*a*, reference signal (p1) 522*a* and pressure signal (r1) 201 to produce output signal (e1) 536*a* and feedback input 532*a*. In some embodiments, feedback input 532*a* is output signal (e1) 536*a*, and an adaptive factor $\mu_a$, is applied to feedback signal 532*a* within adaptive filter 520*a*. Likewise, pump interference filter 500*b* includes a pre-processor module 510*b*, an adaptive filter module 520*b*, and a combiner module 530*b*. Accordingly, pump interference filter 500*b* processes adaptive filter input (x2) 502*b*, filter output (p2) 522*b* and output (e1) 536*a*, to produce output (e2) 536*b* and feedback input 532*b*. In some embodiments, feedback input 532*b* is output signal (e2) 536*b*, and an adaptive factor, $\mu_b$, is applied to feedback signal 532*b* within adaptive filter 520*b*. Pre-processor modules 510*a,b*; adaptive filter modules 520*a,b*; and combiner modules 530*a,b* are as described in detail above with reference to like components (cf. FIG. 3), and will not be described again here. In general, adaptive factors $\mu_b$ and $\mu_b$ are not the same. In some embodiments, adaptive factors $\mu_a$ and $\mu_b$ may be similar or approximately the same.

Figure 6:
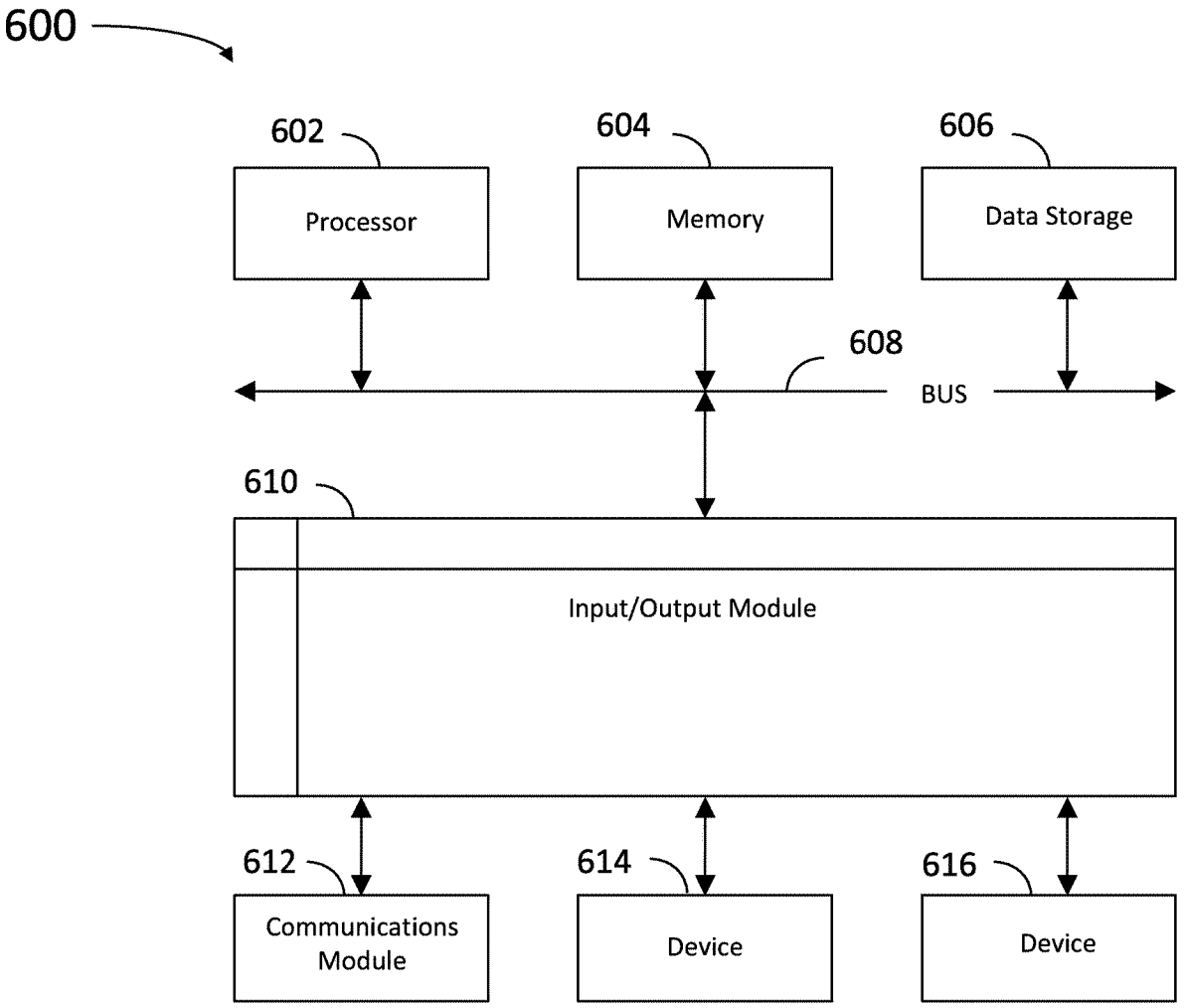
FIG. 6 illustrates a computer system configured for filtering pump interference in mud pulse telemetry, according to some embodiments.

FIG. 6 illustrates a computer system 600 configured for filtering pump interference in mud pulse telemetry, according to some embodiments. According to one aspect of the present disclosure, computer system 600 may be included in a controller for a drilling system (e.g., controller 110 in drilling system 100, cf. FIG. 1). Computer system 600 includes a processor circuit 602 coupled to a bus 608. Bus 608 may also couple other circuits in computer device 600, such as a memory circuit 604, a data storage 606, an input/output (I/O) module 610, a communications module 612, and peripheral devices 614 and 616. In certain aspects, computer system 600 can be implemented using hardware or a combination of software and hardware, either in a dedicated server, or integrated into another entity, or distributed across multiple entities.

Computer system 600 includes a bus 608 or other communication mechanism for communicating information, and a processor circuit 602 coupled with bus 608 for processing information. By way of example, computer system 600 can be implemented with one or more processor circuits 602. Processor circuit 602 can be a general-purpose microprocessor, a microcontroller, a Digital Signal Processor (DSP), an Application Specific Integrated Circuit (ASIC), a Field Programmable Gate Array (FPGA), a Programmable Logic Device (PLD), a controller, a state machine, gated logic, discrete hardware components, or any other suitable entity that can perform calculations or other manipulations of information.

Computer system 600 includes, in addition to hardware, code that creates an execution environment for the computer program in question, e.g., code that constitutes processor firmware, a protocol stack, a database management system, an operating system, or a combination of one or more of them stored in an included memory circuit 604, such as a Random Access Memory (RAM), a flash memory, a Read Only Memory (ROM), a Programmable Read-Only Memory (PROM), an Erasable PROM (EPROM), registers, a hard disk, a removable disk, a CD-ROM, a DVD, or any other suitable storage device, coupled to bus 608 for storing information and instructions to be executed by processor circuit 602. Processor circuit 602 and memory circuit 604 can be supplemented by, or incorporated in, special purpose logic circuitry.

The instructions may be stored in memory circuit 604 and implemented in one or more computer program products, i.e., one or more modules of computer program instructions encoded on a computer readable medium for execution by, or to control the operation of, the computer system 600, and according to any method well known to those of skill in the art, including, but not limited to, computer languages such as data-oriented languages (e.g., SQL, dBase), system languages (e.g., C, Objective-C, C++, Assembly), architectural languages (e.g., Java, .NET), and application languages (e.g., PHP, Ruby, Perl, Python). Instructions may also be implemented in computer languages such as array languages, aspect-oriented languages, assembly languages, authoring languages, command line interface languages, compiled languages, concurrent languages, curly-bracket languages, dataflow languages, data-structured languages, declarative languages, esoteric languages, extension languages, fourth-generation languages, functional languages, interactive mode languages, interpreted languages, iterative languages, list-based languages, little languages, logic-based languages, machine languages, macro languages, metaprogramming languages, multiparadigm languages, numerical analysis, non-English-based languages, object-oriented class-based languages, object-oriented prototype-based languages, off-side rule languages, procedural languages, reflective languages, rule-based languages, scripting languages, stack-based languages, synchronous languages, syntax handling languages, visual languages, wirth languages, embeddable languages, and xml-based languages. Memory circuit 604 may also be used for storing temporary variable or other intermediate information during execution of instructions to be executed by processor circuit 602.

A computer program as discussed herein does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, subprograms, or portions of code). A computer program can be deployed to be executed on one computer or on multiple computers that are located at one site or distributed across multiple sites and interconnected by a communication network. The processes and logic flows described in this specification can be performed by one or more programmable processors executing one or more computer programs to perform functions by operating on input data and generating output.

Computer system 600 further includes a data storage device 606 such as a magnetic disk or optical disk, coupled to bus 608 for storing information and instructions. Computer system 600 is coupled via input/output module 610 to various devices. The input/output module 610 are any input/output module. Example input/output modules 610 include data ports such as USB ports. The input/output module 610 is configured to connect to a communications module 612. Example communications modules 612 include networking interface cards, such as Ethernet cards and modems. In certain aspects, the input/output module 610 is configured to connect to a plurality of devices, such as an input device 614 and/or an output device 616. Example input devices 614 include a keyboard and a pointing device, e.g., a mouse or a trackball, by which a user can provide input to the computer system 600. Other kinds of input devices 614 are used to provide for interaction with a user as well, such as a tactile input device, visual input device, audio input device, or brain-computer interface device. For example, feedback provided to the user can be any form of sensory feedback, e.g., visual feedback, auditory feedback, or tactile feedback; and input from the user can be received in any form, including acoustic, speech, tactile, or brain wave input. Example output devices 616 include display devices, such as a LED (light emitting diode), CRT (cathode ray tube), or LCD (liquid crystal display) screen, for displaying information to the user.

Computer system 600 may be configured to perform steps in a method consistent with any of the methods disclosed herein in response to processor circuit 602 executing one or more sequences of one or more instructions contained in memory circuit 604. Such instructions may be read into memory circuit 604 from another machine-readable medium, such as data storage device 606. Execution of the sequences of instructions contained in main memory circuit 604 causes processor circuit 602 to perform the process steps described herein. One or more processors in a multi-processing arrangement may also be employed to execute the sequences of instructions contained in memory circuit 604. In alternative aspects, hard-wired circuitry may be used in place of or in combination with software instructions to implement various aspects of the present disclosure. Thus, aspects of the present disclosure are not limited to any specific combination of hardware circuitry and software.

Figure 7:
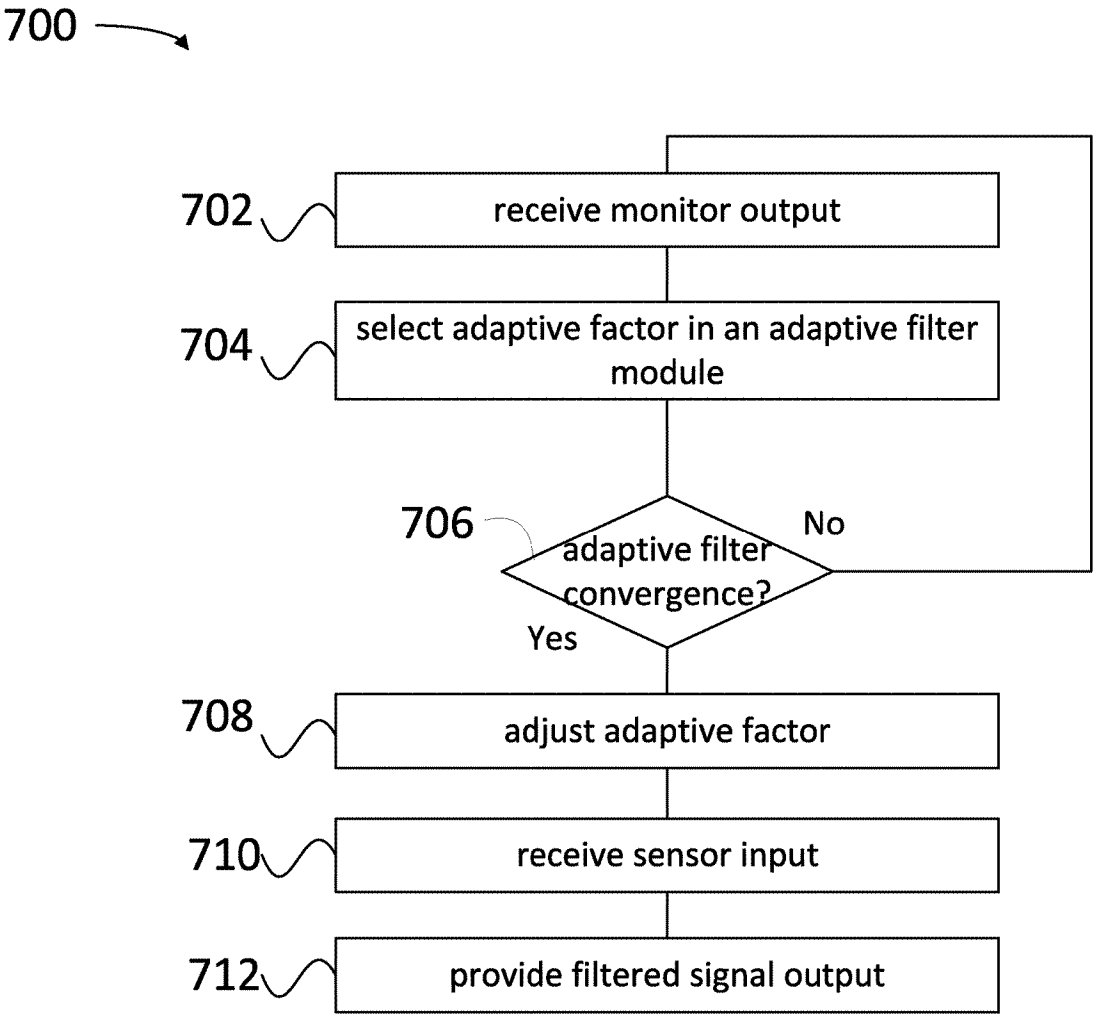
FIG. 7 illustrates a flow chart including steps in a method for filtering pump interference in mud pulse telemetry, according to some embodiments.

FIG. 7 illustrates a flow chart including steps in a method 700 for filtering pump interference in mud pulse telemetry, according to some embodiments. Some embodiments may include steps in method 700 in the context of adjusting a drilling configuration in a drilling system (e.g., drilling system 100, cf. FIG. 1). More generally, steps in method 700 may be performed in any signal processing method where it is desired to remove an interference in real time. Examples of such methods may include digital signal processing protocols in the telecommunication industry. An interference filter including a pre-processor module to provide a adaptive filter input from a monitor output (e.g., pump interference filter 300, pre-processor module 310, and stroke monitor signal 202, cf. FIG. 3) may perform method 700, according to some embodiments. The interference filter may further include an adaptive filter module to provide a reference signal, and a combiner module to provide an output (e.g., pre-processor module 310, stroke monitor signal 202, adaptive filter input 302, adaptive filter module 320, reference signal 322, combiner module 330, feedback signal 332, and output 336, cf. FIG. 3).

Steps in methods consistent with method 700 may be at least partially performed by a computer system having a processor circuit executing commands stored in a memory circuit (e.g., computer system 600, processor circuit 602, and memory circuit 604, cf. FIG. 6). Methods consistent with method 700 may include at least one but not all of the steps in FIG. 7, performed in any order. More generally, methods consistent with the present disclosure may include at least some of the steps in FIG. 7 performed overlapping in time. For example, some embodiments may include at least two steps in FIG. 7 performed simultaneously, or almost simultaneously, in time.

Step 702 includes receiving a monitor output. In some embodiments, step 702 includes receiving the monitor output from the stroke monitor in the pump of the drilling system. In some embodiments, step 702 may include receiving the monitor output with the pre-processor module, and forming a broadband adaptive filter input with the monitor output. For example, in some embodiments forming a broadband output comprises removing flat signal portions from the monitor output in a temporal scale (e.g., adaptive filter input 302 from stroke monitor signal 202, cf. FIG. 4).

Step 704 includes selecting an adaptive factor in an adaptive filter. In some embodiments, step 704 includes selecting an adaptive factor '$\mu$' in Eq. (3) to determine the speed of the adaptive filter convergence. In some embodiments, step 704 includes selecting a relatively large value for the adaptive factor '$\mu$' when a pump interference signal is detected by the acoustic transducer and a message is not transmitted in the mud pressure signal. For example, in some embodiments of method 700 steps 702 through 706 are performed for several second with the pump or pumps 'on' while no data is transmitted by the acoustic transducer. At this stage, and before adaptive filter convergence is achieved, the adaptive factor μ may be large. Accordingly, step 704 may include selecting an adaptive factor μ of about 0.2, or even larger, such as 0.3, 0.4 or more. In some embodiments step 704 includes selecting an adaptive factor, μ, less than one half (0.5), to prevent divergence of the Affine Projection.

Step 706 includes determining whether the adaptive filter has converged. In some embodiments, step 706 may include comparing an absolute value of an error to a threshold (e.g., $|e_n|$, cf. Eq. 2). When the absolute value is less than the threshold, step 706 may determine that the adaptive filter has converged. In some embodiments, step 706 may include comparing an absolute value of a difference in adaptive filter coefficients, to a threshold (e.g., $(|W_n-W_{n+1}|$, cf. Eq. 3). Accordingly, when the absolute value is less than a threshold, step 706 may determine that the adaptive filter has converged. In some embodiments, step 706 includes determining whether a selected number of iterations has been carried out. When the adaptive filter has not converged, steps 702 through 706 are repeated. When the adaptive filter has converged, or when the selected number of iterations has been carried out, step 708 includes adjusting an adaptive factor (e.g., μ, cf. Eq. 3). Accordingly, in some embodiments step 708 may include reducing the value of the adaptive factor. Step 708 may include reducing the adaptation filter by a factor of two, or even more.

Step 710 includes receiving a sensor input. In some embodiments, step 710 includes receiving a signal from a pressure sensor in a drilling system. In some embodiments, step 712 includes subtracting the adaptive filter output from the received pressure sensor input in the combiner module. Further according to some embodiments, step 712 includes feeding the output of the combiner module multiplied by the reduced adaptive factor, back to the adaptive filter. Step 712 includes providing the filtered signal output. In some embodiments, step 712 includes decoding the filtered pressure signal using a digital signal scheme such as PPM or PWM.

In some embodiments, the pump interference may slightly change in frequency or phase, thereby distorting the quality of the filtered signal even after steps 702 through 712 are completed. This may be the case when in a multiple pump configuration one of the pumps is turned 'off', or a new pump is turned 'on'. In some embodiments, when a signal distortion is observed after some time when the system has been operating with optimized adaptation coefficients W, the user may decide to track the pump interference and find new W coefficients. The user may thus reset the gear shifting process by starting with a larger adaptive factor value, μ, and reproducing the steps in method 700 to find new values for adaptive filter coefficients W. Accordingly, method 700 is repeated to adjust the adaptive filter to the new pump interference configuration.

Figure 8:
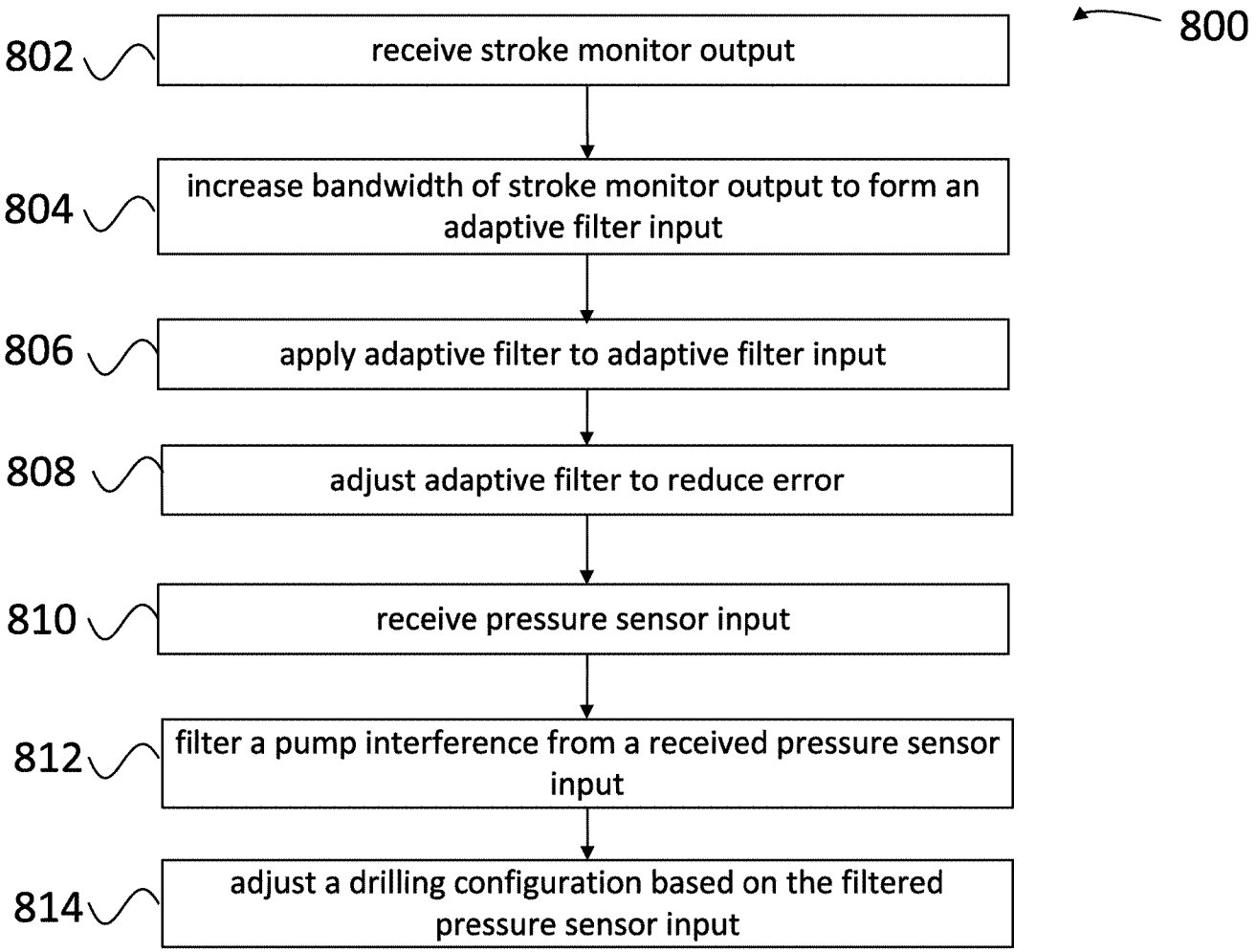
FIG. 8 illustrates a flow chart including steps in a method for filtering pump interference in mud pulse telemetry, according to some embodiments.

FIG. 8 illustrates a flow chart including steps in a method 800 for filtering pump interference in mud pulse telemetry, according to some embodiments. Method 800 may be performed in the context of a drilling system including a drilling rig supporting a drill string coupled to a drill tool forming an underground wellbore (e.g., drilling system 100, drilling rig 150, drill string 133, drill tool 130, and wellbore 120, cf. FIG. 1). In the drilling system, an acoustic transducer near the drill tool may transmit messages between a controller in the surface and the drill tool (e.g., acoustic transducer 102 and controller 110, cf. FIG. 1). The messages may be transmitted through a mud flow and received at the surface by a pressure sensor, the mud flow being pressurized by a pump at the surface (e.g., mud flow 125, pressure sensor 101, and pump 105, cf. FIG. 1). Further, the pump may include a stroke monitor to provide a signal for use by a pump interference filter in the controller (stroke monitor 107, cf. FIG. 1, and pump interference filter 300, cf. FIG. 3). The pump interference filter may include a pre-processor module to provide an adaptive filter input, an adaptive filter module to provide a reference signal, and a combiner module to provide an output (e.g., pre-processor module 310, adaptive filter input 302, adaptive filter module 320, reference signal 322, combiner module 330, and output 336, cf. FIG. 3).

Steps in methods consistent with method 800 may be at least partially performed by a computer system having a processor circuit executing commands stored in a memory circuit (e.g., computer system 600, processor circuit 602, and memory circuit 604, cf. FIG. 6). Methods consistent with method 800 may include at least one but not all of the steps in FIG. 8, performed in any order. More generally, methods consistent with the present disclosure may include at least some of the steps in FIG. 8 performed overlapping in time. For example, some embodiments may include at least two steps in FIG. 8 performed simultaneously, or almost simultaneously, in time.

Step 802 includes receiving a stroke monitor signal. In some embodiments, step 802 includes receiving a stroke monitor signal from a mud pump in a drilling system. In some embodiments, step 802 may further include receiving the monitor output with the pre-processor module.

Step 804 includes increasing the bandwidth of the stroke monitor to form an adaptive filter input. Step 804 includes forming an adaptive filter input having a frequency bandwidth broader than the monitor output with the pre-processor module. Accordingly, step 804 may include removing flat portions in a waveform representing a time sequence of the stroke monitor signal. For example, step 804 may include removing the flat portions representing a 'high' signal value in the stroke monitor signal, leaving the sharp ends formed by the positive and negative slope of the stroke monitor signal (cf. FIG. 4).

Step 806 includes applying adaptive filter to the adaptive filter input. In some embodiments, step 806 includes selecting an adaptive factor for the adaptive filter. Step 808 includes adjusting the adaptive filter to reduce an error. In some embodiments step 808 includes providing an adaptive filter output as feedback to the adaptive filter module. Further, in some embodiments step 808 includes modifying an adaptive factor to reduce the amplitude of an adaptive filter output. Step 810 includes receiving a pressure sensor input. In some embodiments, step 810 includes receiving a signal from a pressure sensor in a drilling system. Further according to some embodiments, step 810 includes reducing the adaptive factor to about 50% of its previous value.

Step 812 includes filtering a pump interference from a received pressure sensor input. In some embodiments, step 812 includes subtracting the adaptive filter output from the received pressure sensor input in the combiner module. Further according to some embodiments, step 812 includes feeding the output of the combiner module multiplied by a reduced adaptive factor, back to the adaptive filter. In some embodiments, step 812 includes decoding the filtered pressure signal using a digital signal scheme such as PPM or PWM.

Step 814 includes adjusting a drilling configuration based on the filtered pressure sensor input. In some embodiments, step 814 may include increasing, reducing, or stopping a drilling speed. In some embodiments, step 818 may include causing steering the drill tool in a different direction. For example, the drill tool may be steered from a vertical drilling configuration to a horizontal or almost horizontal drilling configuration. In some embodiments, step 814 includes adjusting the mud flow. For example, step 814 may include increasing or reducing the mud flow. In some embodiments, step 814 includes increasing or reducing the pump pressure. Moreover, in some embodiments step 814 may include adding chemicals and other additives to the mud flow.

It is recognized that the various embodiments herein directed to computer control and artificial neural networks, including various blocks, modules, elements, components, methods, and algorithms, can be implemented using computer hardware, software, combinations thereof, and the like. To illustrate this interchangeability of hardware and software, various illustrative blocks, modules, elements, components, methods and algorithms have been described generally in terms of their functionality. Whether such functionality is implemented as hardware or software will depend upon the particular application and any imposed design constraints. For at least this reason, it is to be recognized that one of ordinary skill in the art can implement the described functionality in a variety of ways for a particular application. Further, various components and blocks can be arranged in a different order or partitioned differently, for example, without departing from the scope of the embodiments expressly described.

Computer hardware used to implement the various illustrative blocks, modules, elements, components, methods, and algorithms described herein can include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable read only memory (EPROM)), registers, hard disks, removable disks, CD-ROMs, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM, and flash EPROM.

Embodiments disclosed herein include:

A. A method, including receiving a monitor output, selecting an adaptive factor in an adaptive filter module, adjusting the adaptive factor when the adaptive filter module has reached convergence, receiving a sensor input, providing a filtered signal output, and modifying a drill configuration based on the signal output.

B. A device, including a memory circuit storing commands, a processor circuit configured to execute the commands, causing the device to receive a monitor output, select an adaptive factor in an adaptive filter module, adjust the adaptive factor when the adaptive filter module has reached convergence, receive a sensor input, provide a filtered signal output, and modify a drill configuration based on the signal output.

C. A method, including receiving a stroke monitor signal, increasing a bandwidth of the stroke monitor signal to form an adaptive filter input, applying an adaptive filter to the adaptive filter input, adjusting the adaptive filter to reduce an error, receiving a pressure sensor input, filtering a pump interference from the received pressure sensor input, and adjusting a drilling configuration based on the filtered pressure signal.

Each of embodiments A, B, and C may have one or more of the following additional elements in any combination. Element 1: wherein receiving a sensor input includes receiving a signal from a pressure sensor in a drilling system. Element 2: wherein receiving a monitor output includes receiving a stroke monitor signal from a mud pump in a drilling system. Element 3, wherein receiving the monitor output further includes forming an adaptive filter input having a frequency bandwidth broader than the monitor output. Element 4: including providing the adaptive filter input to the adaptive filter module. Element 5: wherein adjusting the adaptive factor includes reducing the adaptive factor to about 50% of its previous value. Element 6: further including providing the difference between the received sensor input and the adaptive filter output modified by the adaptive factor as a feedback to the adaptive filter module. Element 7: wherein providing a filtered signal output includes modifying an adaptive filter module factor to reduce the amplitude of the signal output. Element 8: wherein modifying a drill configuration based on the signal output includes steering a drill tool from a vertical drilling configuration to a horizontal drilling configuration. Element 9: wherein the monitor output includes a stroke monitor signal from a mud pump in a drilling system. Element 10: further including a second adaptive filter module configured to receive a second monitor output and the filtered signal output, the second monitor output including a stroke monitor signal from a second mud pump in a drilling system. Element 11: further including a pre-processor module configured to provide an input to the adaptive filter module, wherein the input to the adaptive filter module has a broader bandwidth than the monitor output.

Element 12: wherein the commands causing to receive the sensor input include commands to receive a signal from a pressure sensor in a drilling system. Element 13: wherein the commands causing to modify a drill configuration based on the signal output include commands to steer a drill tool from a vertical drilling configuration to a horizontal drilling configuration.

Element 14: further including providing an adaptive filter output as feedback to the adaptive filter module. Element 15: wherein adjusting the adaptive filter to reduce an error includes modifying an adaptive factor to reduce the amplitude of an adaptive filter output. Element 16: wherein receiving a pressure sensor input includes receiving a signal from a pressure sensor in a drilling system. Element 17: wherein adjusting a drilling configuration based on the filtered pressure signal comprises steering a drill tool from a vertical drilling configuration to a horizontal drilling configuration.

The exemplary embodiments described herein are well adapted to attain the ends and advantages mentioned as well as those that are inherent therein. The particular embodiments disclosed above are illustrative only, as the exemplary embodiments described herein may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A method, comprising:

receiving a monitor output and a sensor input;

selecting an adaptive factor in an adaptive filter module;

adjusting the adaptive factor until the adaptive filter module has reached convergence, wherein the adaptive factor, the sensor input, and the monitor output are utilized to determine coefficients of the adaptive filter module, wherein convergence of the coefficients is indicative of the convergence of the adaptive filter module; and wherein the monitor output is a stroke monitor signal from a mud pump in a drilling system, the stroke monitor signal indicating an amplitude of a stroke of the mud pump over time;

providing a filtered signal output based on the coefficients of the adaptive filter module and the sensor input; and modifying a drill configuration based on the filtered signal output.

2. The method of claim 1, wherein receiving a sensor input comprises receiving a signal from a pressure sensor in a drilling system.

3. The method of claim 1, wherein receiving the monitor output further comprises forming an adaptive filter input having a frequency spectrum bandwidth broader than the monitor output.

4. The method of claim 3, further comprising providing the adaptive filter input to the adaptive filter module.

5. The method of claim 3, wherein forming the adaptive filter input comprises adjusting an amplitude of the monitor output.

6. The method of claim 1, wherein adjusting the adaptive factor comprises reducing the adaptive factor to about 50% of its previous value.

7. The method of claim 1, further comprising providing a difference between the received sensor input and an adaptive filter output modified by the adaptive factor as a feedback to the adaptive filter module.

8. The method of claim 1, wherein providing a filtered signal output comprises modifying the adaptive factor to reduce an amplitude of the signal output.

9. The method of claim 1, wherein modifying a drill configuration based on the signal output comprises steering a drill tool from a vertical drilling configuration to a horizontal drilling configuration.

10. A device, comprising:

a memory circuit storing commands;

a processor circuit configured to execute the commands, causing the device to:

receive a monitor output and a sensor input;

select an adaptive factor in an adaptive filter module;

adjust the adaptive factor until the adaptive filter module has reached convergence, wherein the adaptive factor, the sensor input, and the monitor output are utilized to determine coefficients of the adaptive filter module; wherein convergence of the coefficients is indicative of the convergence of the adaptive filter module; and wherein the monitor output is a stroke monitor signal from a mud pump in a drilling system, the stroke monitor signal indicating an amplitude of a stroke of the mud pump over time;

provide a filtered signal output based on the coefficients of the adaptive filter module and the sensor input; and modify a drill configuration based on the filtered signal output.

11. The device of claim 10, further comprising a second adaptive filter module configured to receive a second monitor output and the filtered signal output, the second monitor output comprising a stroke monitor signal from a second mud pump in a drilling system.

12. The device of claim 10, further comprising a preprocessor module configured to provide an input to the adaptive filter module, wherein the input to the adaptive filter module has a broader frequency spectrum bandwidth than the monitor output.

13. The device of claim 12, wherein the input to the adaptive filter module is formed by adjusting an amplitude of the monitor output.

14. The device of claim 10, wherein the commands causing to receive the sensor input comprise commands to receive a signal from a pressure sensor in a drilling system.

15. The device of claim 10, wherein the commands causing to modify a drill configuration based on the signal output comprise commands to steer a drill tool from a vertical drilling configuration to a horizontal drilling configuration.

16. A method, comprising:

receiving a stroke monitor signal;

increasing a bandwidth of the stroke monitor signal to form an adaptive filter input, wherein increasing the bandwidth of the stroke monitor signal comprises removing a portion of the stroke monitor signal between a rising edge and a falling edge;

applying an adaptive filter to the adaptive filter input;

adjusting the adaptive filter to reduce an error;

receiving a pressure sensor input;

filtering a pump interference from the received pressure sensor input; and adjusting a drilling configuration based on the filtered pressure sensor input.

17. The method of claim 16, further comprising providing an adaptive filter output as feedback to the adaptive filter.

18. The method of claim 16, wherein adjusting the adaptive filter to reduce an error comprises reducing an adaptive factor utilized to determine coefficients of the adaptive filter.

19. The method of claim 16, wherein receiving a pressure sensor input comprises receiving a signal from a pressure sensor in a drilling system.

20. The method of claim 16, wherein adjusting a drilling configuration based on the filtered pressure sensor input comprises steering a drill tool from a vertical drilling configuration to a horizontal drilling configuration.

* * * * *